United States Patent [19]

Rönning

[11] Patent Number: 4,542,874

[45] Date of Patent: Sep. 24, 1985

[54] BRACKET FOR A WORK PLATFORM

[76] Inventor: Tor Rönning, Aspövägen 51, S-125 40 Älvsjö, Sweden

[21] Appl. No.: 552,132

[22] PCT Filed: Feb. 18, 1983

[86] PCT No.: PCT/SE83/00053

§ 371 Date: Sep. 28, 1983

§ 102(e) Date: Sep. 28, 1983

[87] PCT Pub. No.: WO83/02977

PCT Pub. Date: Sep. 1, 1983

[30] Foreign Application Priority Data

Feb. 18, 1982 [SE] Sweden ..... 8201018

[51] Int. Cl.[4] ..... E06C 7/16

[52] U.S. Cl. ..... 248/238; 182/121

[58] Field of Search ..... 248/238; 182/117, 121, 182/214

[56] References Cited

U.S. PATENT DOCUMENTS

| | | | |
|---|---|---|---|
| 567,755 | 9/1896 | Stillman | 182/117 |
| 1,216,214 | 2/1917 | Connell . | |
| 1,462,086 | 7/1923 | Echlin . | |
| 1,474,289 | 11/1923 | Reimann | 248/238 |
| 1,497,120 | 6/1924 | Riker | 182/117 |
| 2,665,952 | 1/1954 | Edwards . | |
| 2,910,135 | 10/1959 | Moore | 182/121 |
| 3,966,340 | 6/1976 | Morris | 108/156 |

FOREIGN PATENT DOCUMENTS

| | | | |
|---|---|---|---|
| 2407103 | 8/1975 | Fed. Rep. of Germany . | |
| 625362 | 8/1927 | France | 248/238 |
| 2467568 | 5/1981 | France | 248/460 |
| 81545 | 7/1934 | Sweden . | |
| 15538 | of 1900 | United Kingdom | 248/238 |
| 181232 | 5/1921 | United Kingdom . | |
| 273501 | 7/1927 | United Kingdom . | |

*Primary Examiner*—Reinaldo P. Machado
*Assistant Examiner*—Alvin Chin-Shue
*Attorney, Agent, or Firm*—Oblon, Fisher Spivak, McClelland & Maier

[57] ABSTRACT

A bracket is adapted for mounting on a ladder (1) as the support means for a work platform as one or more planks. The bracket comprises an arm (2) as a seat for the platform, a carrying bar (3) adapted for being suspended in one of the rungs (4) of the ladder and engaging against a rung situated lower down, and a strut (5) arranged between the carrying bar and arm to support the latter substantially horizontally oriented. The strut has a hook means (6) for optional coaction with one of a row of notches (7) along the carrying bar. The arm is joined to the carrying bar at a first joint (9) and to the strut at a second joint (11). The second joint is movable and comprises two or more non-round and preferably like holes (14) along the arm coacting with a headed stud on the strut. The stud and its head are non-rotatably fixed to the strut, and formed to allow insertion of the head through the hole in only one, or some, previously determined swinging positions of the free strut, for locking the strut pivotably to the arm by swinging the strut into engagement with the carrying bar. The first joint is permanent. The mutually opposing faces of the arm and supporting bar are formed such as to allow swinging the arm and bar about the first joint and into mutually essentially parallel orientation of their longitudinal axes after the strut has been removed.

3 Claims, 4 Drawing Figures

BRACKET FOR A WORK PLATFORM

DESCRIPTION

The invention relates to a bracket for mounting on a ladder as support for a work platform such as one or more planks. The bracket consists of an arm serving as a seat for the platform, a carrying bar adapted for suspension from one of the rungs of the ladder and engagement against a rung lower down on the ladder, and a strut arranged between the carrying bar and arm, for supporting the arm substantially horisontally oriented. The strut has hook means for optional coaction with one of a row of notches made along the carrying bar, the arm being connected to the carrying bar at a first joint and to the strut at a second joint.

Such a bracket is already known from the British Patent Specification No. 273 501. Similar to other brackets in the art for the same purpose, it is burdened with the disadvantage of being rather complicated and bulky as well as unhandy when it is collapsed as far as is possible. This latter drawback is very much of a disadvantage in storage and distribution in marketing the brackets as well as storing by the consumer.

The object of the invention is therefore to provide a simple bracket which requires small space in storage. It is also a prerequisite that the solution must offer at least the same safety as the brackets in the art.

The desired result is obtained by the bracket being given the characterizing features disclosed by the following claim 1.

An embodiment of the invention is described in detail in the following with reference to the accompanying drawing, on which FIG. 1 is a perspective view of a bracket mounted on the front of a ladder for carrying one end of a working platform.

Figure 1:
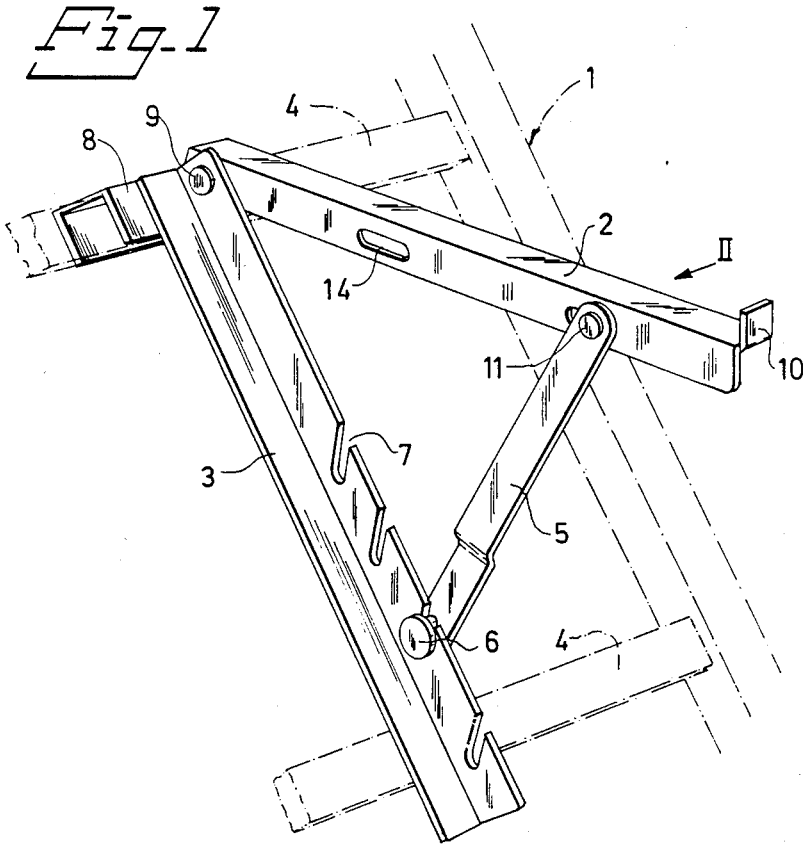
Figure 3:
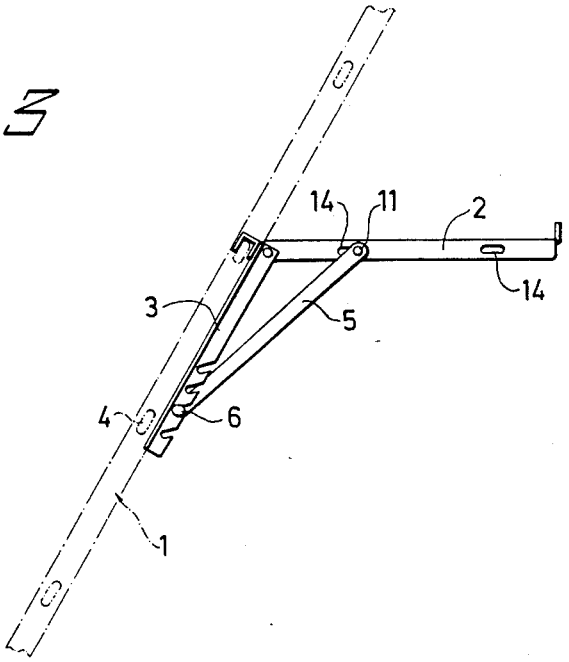
FIG. 3 is a side view showing how the bracket is mounted on the underside of a ladder for carrying one end of a work platform.

As will be seen from FIGS. 1 and 3 the bracket is adapted for be mounting on a ladder 1, to serve as the support means for an unillustrated work platform, such as can consist of one or more planks. With the aid of two or more ladders and just as many brackets, such a platform can be supported at its ends and furthermore at other parts of it as well.

The bracket comprises an arm 2 serving as support for the platform, a carrying bar 3 adapted for being suspended from one of the rungs 4 of the ladder 1 and engagement against a rung 4 lower down the ladder, there being a strut 5 arranged between the carrying bar 3 and arm 2 for supporting the arm substantially horizontally.

The strut 5 has a hook means 6 for optional coaction with one of four notches in a row along the edge of the carrying bar 3 nearest the strut. These notches are at an angle, opening slopingly upwards, to keep the hook means 6 safely in place under the weight of the bracket, platform and platform load, when the means is put into one of the notches on placing the bracket on the ladder. The hook means 6 comprises a stud provided with a head, the stud itself fitting any one of the notches 7 while its head prevents movement of the stud in the longitudinal direction thereof and out of engagement with the notch.

The carrying bar 3 is made from a length of angle section which has one flange facing towards the rungs and its other flange outstanding and provided with the notches 7. At its upper end the bar has a hook 8 dimensioned to accommodate a rung 4 of conventional shape and dimension.

The arm 2 is similarly made from a length of angle section having a flange facing towards the outside face of the outstanding flange of the bar 3. The arm and bar are joined at a first joint 9 in the form of a permanently mounted riveted or welded bolt for example, rotatable in either or both parts and situated in juxtaposed end portions of the mutually engaging flanges. At its free end the arm 2 has an upstanding flap 10 as a stop for the platform.

The arm 2 is furthermore connected to the strut 5 at a second joint 11. This joint is formed at the free end of the strut by a stud 12 having a rigidly attached head 13, these parts arranged for coaction with either of two holes 14 in the arm.

Figure 2:
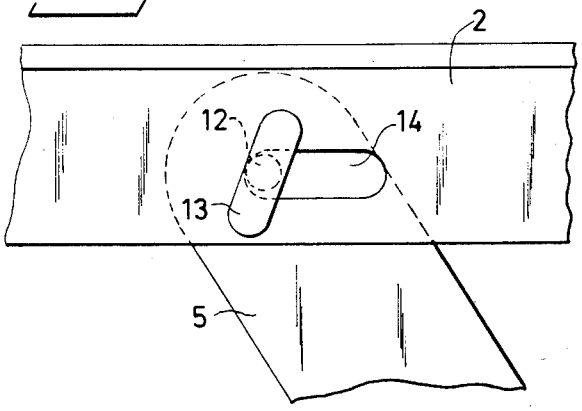
FIG. 2 is a partial side view seen in the direction of arrow II in FIG. 1.

The joint 11 is thus movable. Both holes 14 are alike and non-round, or more specifically elongate and of uniform width. In a plane at right angles to the longitudinal axis of the pin the head 13 of the stud 12 has a configuration such as to enable its insertion in either of the holes 14 when the head is oriented in the same direction as the hole. As will be seen from FIG. 2, the head 13 is set at an angle in relation to the longitudinal axis of the strut 5, and can be taken through the hole 14 only when the strut is free from the carrying bar 3, and swung to a position putting the head in register with the hole. After the strut has been hooked into the arm the joint 10 is consequently locked against release as soon as the strut is hooked into the carrying bar as well.

Figure 4:
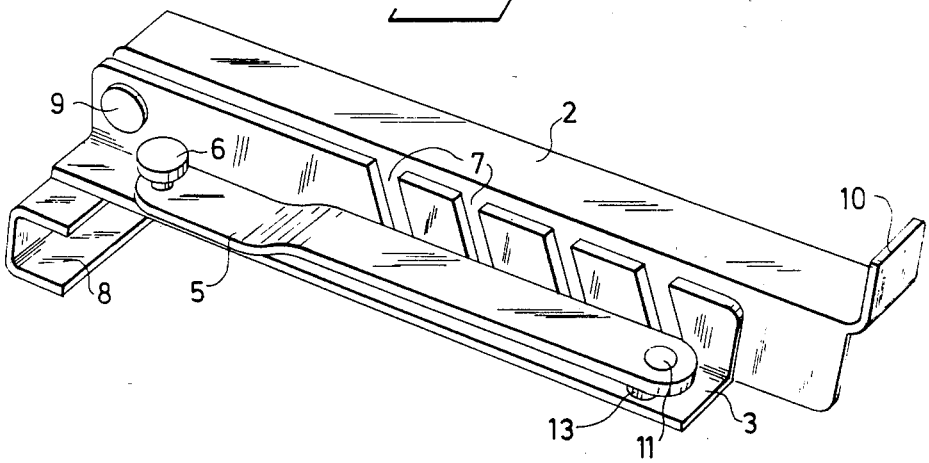
FIG. 4 illustrates how the bracket only takes up a very small space when collapsed and in its packed condition.

The mutually opposing faces of the arm 2 and bar 3 comprise flat and parallel surfaces on their flanges connected by the joint 9. This implementation allows the arm and bar to swing about the joint 9 into mutual, parallel orientation of their longitudinal axes when the strut 5 is disconnected and removed. As will be seen from FIG. 4 the bracket can thus be packed together into a format needing small space for storage and transport. The strut 5 is then placed either in the space between the flanges of the arm or the supporting bar (as shown).

FIG. 3 illustrates the bracket suspended at the back and underside of a ladder, the strut 5 being connected to the inward hole 14 on the arm 2, so that even when the bracket is suspended in this way, and with suitable positioning of the strut in one of the notches 7 of the carrying bar 3, the bracket will afford a substantially horisontal arm as a seat for the platform.

This arrangement makes it more convenient to step over from the ladder to the platform.

Although the illustrated embodiment is expected to be the most practicable, it is possible to give the mutually opposing faces of the arm and supporting bar a shape other than the one that is flat, without the mutual swinging to a substantial parallel orientation of their longitudinal axes being adventured. More holes 14 than the two shown may furthermore be arranged in the arm, as well as their being implemented with some other non-round and locking configuration than the one shown. The number of notches 7 can naturally be more or less than what is shown. It is also possible to position the joint 9 further up than the hook 8, and to extend the arm 2, so that platform planks can be placed both in front of and behind the ladder. The invention is not restricted, either in these or other respects, to the illustrated embodiment, but may be varied within the scope of claim 1.

I claim:

1. A work platform support bracket for mounting on a ladder, said bracket comprising:

a carrying bar including means for suspension of said carrying bar from one rung of a ladder with said carrying bar extending downward in a plane of said ladder and engaging with at least one other rung lower than said one rung, said carrying bar including a longitudinal axis and a plurality of notches spaced along said axis;

an arm usable as a seat for a work platform, said arm having a longitudinal axis;

a first permanent pivot joint between said carrying bar and said arm, said first joint including means to permit relative pivoting between said carrying bar and said joint about an axis transverse to said carrying bar and arm longitudinal axes, said carrying bar and arm having mutually opposed faces shaped to permit pivoting at said first joint by a degree such that said carrying bar and arm longitudinal axes extend parallel to one another;

a strut having hook means at one end for engagement with selected ones of said notches;

a second joint between said arm and a second end of said strut such that said arm may be held horizontal and angularly spaced from said carrying bar by engagement of said strut with said carrying bar at said notches and with said arm at said second joint, said second joint comprising a releasable pivot joint including:

(a) at least two holes in said arm, said holes being spaced along said arm axis and each of said holes being elongated in the direction of said arm axis, (b) a stud fixed to said second end of said strut, said stud being shaped and oriented to be insertable in said holes, (c) a head fixed to said stud, said head being shaped and oriented such that said head can enter and exit from said holes only when said one end of said strut is angularly positioned relative to said arm such that said one end of said strut is not engageable with said carrying bar, whereby said strut is locked to said arm in use.

2. Bracket as claimed in claim 1 wherein said mutually opposing faces of the arm and carrying bar are substantially flat and parallel.

3. Bracket as claimed in claim 1 or 2 wherein said head is elongated in a direction at right angles to the longitudinal axis of the stud, said head direction being at an angle in relation to the longitudinal axis of the strut.

* * * * *